US009067252B2

(12) United States Patent
Christianson et al.

(10) Patent No.: US 9,067,252 B2
(45) Date of Patent: Jun. 30, 2015

(54) SYSTEM AND METHOD OF FORMING HOLE IN BLANK DURING HYDROFORMING PROCESS

(71) Applicant: Caterpillar Inc., Peoria, IL (US)

(72) Inventors: Scott A. Christianson, Edelstein, IL (US); Mark W. Hammerton, Peoria, IL (US); Murray R. Mason, Keswick (CA)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/066,721

(22) Filed: Oct. 30, 2013

(65) Prior Publication Data

US 2015/0114063 A1 Apr. 30, 2015

(51) Int. Cl.

| | |
|---|---|
| ***B21D 35/00*** | (2006.01) |
| ***B21D 26/033*** | (2011.01) |
| ***B21D 28/28*** | (2006.01) |
| ***B26F 1/14*** | (2006.01) |

(52) U.S. Cl.

CPC ..... *B21D 35/001* (2013.01); *B21D 26/033* (2013.01); *B21D 28/28* (2013.01); *B26F 1/14* (2013.01)

(58) Field of Classification Search

CPC .... B21D 35/001; B21D 26/033; B21D 28/28; B26F 1/14

USPC ..... 72/55, 58; 83/53, 54

See application file for complete search history.

(56) References Cited

U.S. PATENT DOCUMENTS

| | | | | |
|---|---|---|---|---|
| 4,989,482 | A * | 2/1991 | Mason | 83/22 |
| 5,460,026 | A * | 10/1995 | Schafer | 72/55 |
| 5,816,089 | A * | 10/1998 | Marando | 72/55 |
| 6,006,566 | A * | 12/1999 | Huelsberg et al. | 72/55 |
| 6,591,648 | B1 * | 7/2003 | Ash et al. | 72/55 |
| 6,658,908 | B1 | 12/2003 | Ghiran et al. | |
| 7,021,098 | B2 * | 4/2006 | Griskiewitz et al. | 72/55 |
| 7,249,480 | B2 * | 7/2007 | Ghiran et al. | 72/55 |
| 7,464,571 | B2 | 12/2008 | Uchida | |
| 7,552,535 | B2 | 6/2009 | Dicesare | |
| 8,459,077 | B2 * | 6/2013 | Abe et al. | 72/55 |
| 8,464,566 | B2 | 6/2013 | Neumann et al. | |

FOREIGN PATENT DOCUMENTS

| | | |
|---|---|---|
| DE | 10304068 | 10/2003 |
| DE | 102007007383 | 8/2008 |
| EP | 1321201 | 8/2004 |
| JP | 57165134 | 10/1982 |
| JP | 2000190035 | 7/2000 |
| JP | 2000351027 | 12/2000 |
| JP | 2006116553 | 5/2006 |
| JP | 2013107083 | 6/2013 |

* cited by examiner

*Primary Examiner* — David B Jones

(74) *Attorney, Agent, or Firm* — BakerHostetler

(57) ABSTRACT

A method of forming a hole in a hollow blank during a hydroforming process is provided. The method includes placing a blank in a cavity of a hydroforming die, the hydroforming die being configured to permit a punch to engage the blank. An interior of the blank is pressurized with a fluid. Further, a cutting end of a punch is applied through a wall portion of the blank and into the interior of the blank to form a hole. Furthermore, the cutting end of the punch is removed from the interior of the blank such that the cutting end of the punch is configured to allow material of the blank surrounding the formed hole to move away from the interior of the blank.

19 Claims, 9 Drawing Sheets

SYSTEM AND METHOD OF FORMING HOLE IN BLANK DURING HYDROFORMING PROCESS

TECHNICAL FIELD

The present disclosure relates to hydroforming process of a hollow blank, and more particularly to a system and a method of forming a hole in the hollow blank during the hydroforming process.

BACKGROUND

Conventional method of cold forming metal tubes to create structural members, for example, for the automotive industry, is hydroforming. In a typical hydroforming process, a metallic sheet and/or metal hollow tube is partially deformed by stamping it in a hydroforming die element. Then, internal hydraulic pressure exceeding the yield strength of the tube wall is applied to force the tube to expand and conform to the die cavity.

After either the hydroforming process or the liquid impact forming process, holes are typically pierced or punched into the structural tube, for example, to provide points of attachment. Typically, punching holes deforms the metal surrounding the hole.

U.S. Pat. No. 7,552,535 relates to a method for manufacturing a hydroforming member includes the step of providing a blank. The blank is defined by blank wall. The blank is placed in a die assembly having a die cavity defined by a die surface. The blank is expanded so that the blank wall is forced against the die surface to form the hydroformed member. A portion of the blank wall conforms against a wall-thinning element positioned along the die surface to form a removable wall section in a portion of the blank wall. The removable wall section is then removed from the blank wall to form an opening in the hydroformed member in a separate die and process.

SUMMARY OF THE DISCLOSURE

In one aspect of the present disclosure, A method of forming a hole in a hollow blank during a hydroforming process is provided. The method includes placing a blank in a cavity of a hydroforming die, the hydroforming die being configured to permit a punch to engage the blank. An interior of the blank is pressurized with a fluid. Further, a cutting end of a punch is applied through a wall portion of the blank and into the interior of the blank to form a hole. Furthermore, the cutting end of the punch is removed from the interior of the blank such that the cutting end of the punch is configured to allow material of the blank surrounding the formed hole to move away from the interior of the blank.

In another aspect of the present disclosure, a method of piercing a hole in a wall of a tube during a hydroforming process is provided. A blank is placed in a cavity of a hydroforming die. The hydroforming die is configured to permit a punch to engage the blank. An interior of the blank is pressurized with a fluid. Further, a cutting end of a punch is applied through a wall portion of the blank and into the interior of the blank to form a hole. A portion of the cutting end of the punch has a groove circumferentially disposed about the punch, material surrounding the hole being displaced from its original position by an initial displacement and then allowed to be displaced within the groove to an intermediate displacement closer to its original position. Further, the cutting end of the punch is removed from the interior of the blank, wherein a first surface forming the groove is capable of engaging the material surrounding the hole away from the intermediate displacement to a final displacement.

In a yet another aspect of the present disclosure, a punch for piercing a hole in a blank during a hydroforming process is provided. The punch includes a shank portion and a cutting end provided on the shank portion. The cutting end is configured to form a hole in the blank. Further, the punch includes a reduced cross-sectional area disposed about an outer surface of the punch and adjacent to the cutting end. The reduced cross-sectional area is configured to allow material of the blank surrounding the formed hole to move away from the interior of the blank.

Other features and aspects of this disclosure will be apparent from the following description and the accompanying drawings.

DETAILED DESCRIPTION

Figure 2:
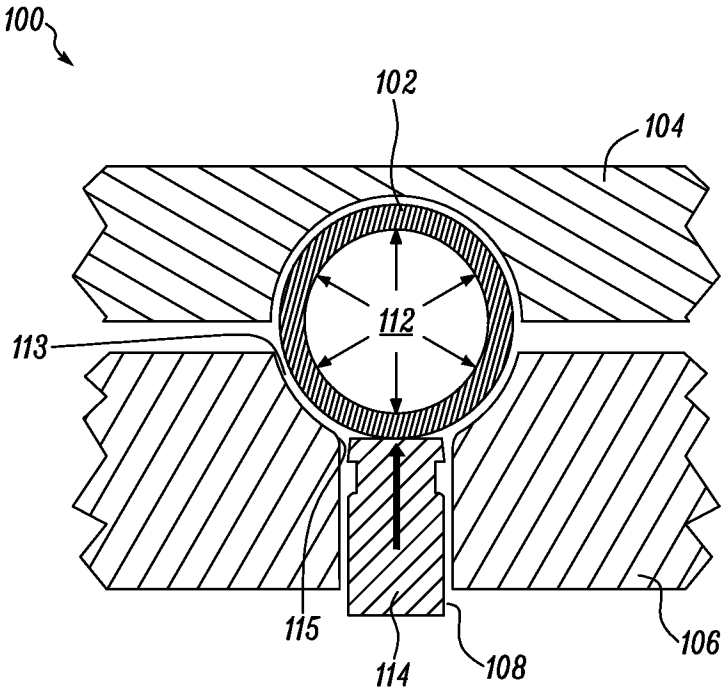
FIG. 2 illustrates the sectional view of a blank and hydroforming punch being initially engaged.

The present disclosure relates to a system and method of forming a hole in a hollow blank during a hydroforming process. FIGS. 1 to 4 illustrate a sectional view of a system 100 for hydroforming a hollow blank 102, hereinafter referred to as blank 102, during a hydroforming process. In an exemplary embodiment, the blank 102 may be a hollow tube. In various alternate embodiments, the blank 102 may be a sheet metal, such as an aluminum sheet, steel sheet, or other metallic sheet. As will be generally understood by a person having ordinary skill in the art that the hydroforming process is a method of shaping ductile metals and alloys of aluminum, brass, low carbon alloy steel, stainless steels into lightweight, structurally stiff and strong pieces. The system 100 may be used for producing hydro formed blanks 102 which may be used in roll over protections structure (ROPS), automobile bodies, aircraft panels, or other safety structures.

The system 100 may include multiple die elements, such as, an upper hydroforming die element 104 and a lower hydroforming die element 106 having a cavity 108. The blank 102 is placed between the hydroforming die elements 104 and 106 of the system 100. The blank 102 may have open ends (not shown) such that one of the open ends of the blank 102 may be selectively sealed, while the other end remains selectively open to facilitate filling of a fluid 112 within the blank 102 to pressurize an interior of the blank 102. In an exemplary embodiment of the present disclosure, the fluid 112 may be a readily available, inexpensive and non-harmful fluid such as water. In various alternate embodiments, the fluid 112 may include additives such as lubricants, bactericides, rust preventives, or other additives known in the art. Once the blank 102 is filled with the pressurized fluid 112, the other end of the blank 102 may be also sealed. In an exemplary aspect of the present disclosure, the blank 102 is sealed at both the ends by attaching caps (not shown) to both the open ends of the blank 102 such that the caps form a pressure tight seal that can withstand elevated pressures to which the interior of the blank 102 is subjected to during the hydroforming process.

Figure 1:
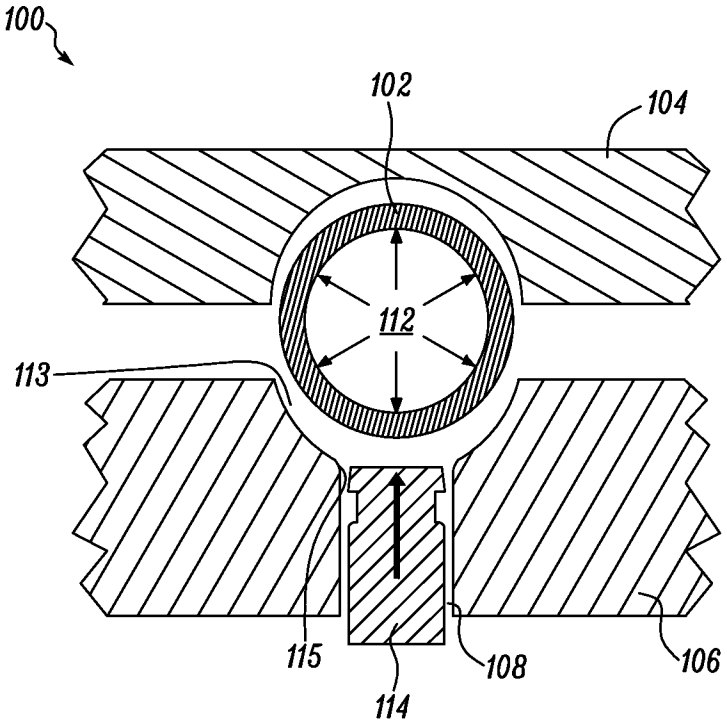
FIG. 1 illustrates a sectional view of a system for performing a hydroforming process.

As shown in FIG. 1, the blank 102 may be placed on the cavity 108 of the lower hydroforming die element 106. Further, the upper and lower hydroforming die elements 104, 106 may be moved relatively closer to one another (as shown in FIG. 2). In an embodiment, the blank 102 is placed on the cavity 108 of the lower hydroforming die element 106 such that a predetermined distance, such as a gap 113 is maintained between the blank 102 and the lower hydroforming die element 106. Further, the lower hydroforming die element 106 includes a recessed portion 115 positioned towards the cavity 108, and configured to facilitate the blank 102 to be placed properly on the cavity 108.

Figure 4:
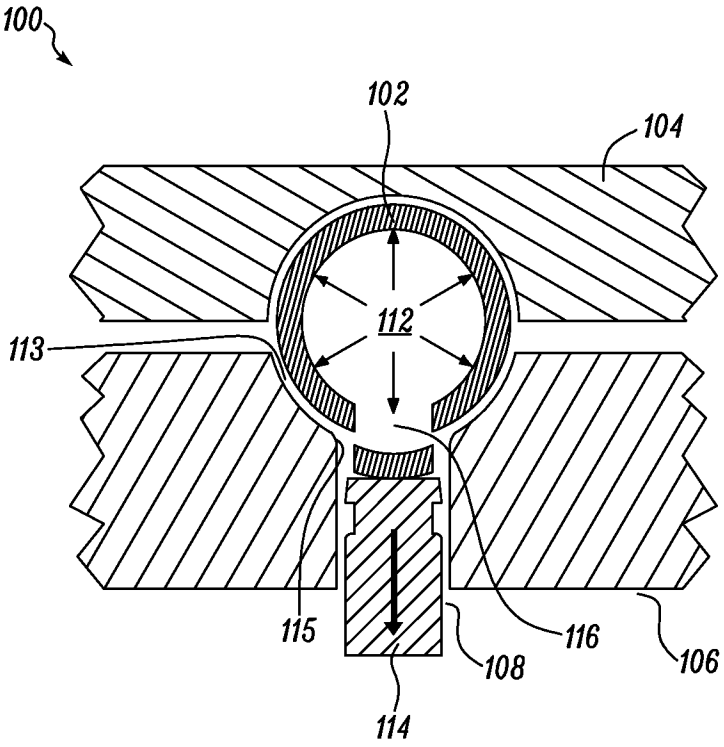
FIG. 4 illustrates the sectional view of the removed hydroforming punch after piercing the blank.
Figure 3:
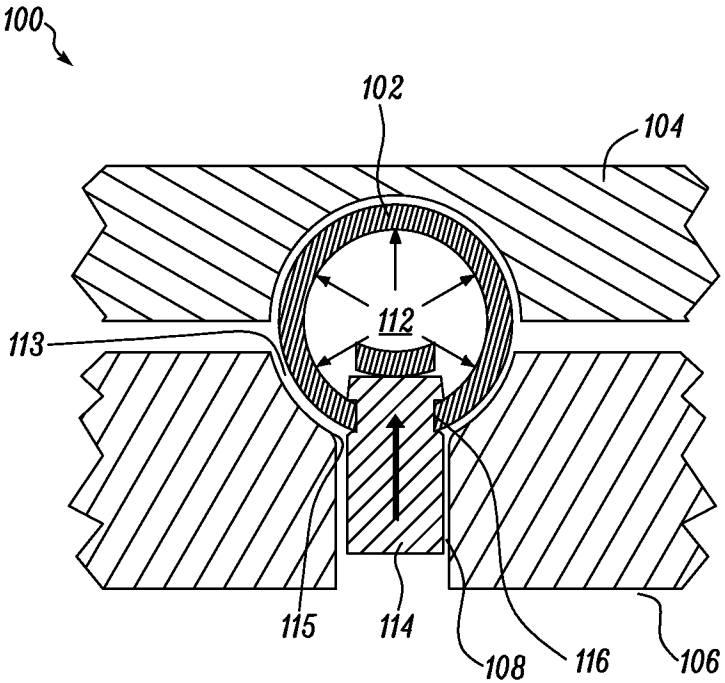
FIG. 3 illustrates the sectional view of the blank after being pierced by a hydroforming punch.

In an aspect of the present disclosure, the system 100 includes a hydroforming punch 114 configured to engage the blank 102, and stamp and/or form a hole 116 in the blank 102, as shown in FIG. 4. The punch 114 may be connected to a hydraulic motor at a lower end, which drives the punch 114 through the cavity 108. Further, as shown in FIG. 3, compression between the upper hydroforming die element 104 and the lower hydroforming die element 106, and the internal fluid pressure of the fluid 112 on the interior of the blank 102 increases, thereby causing the punch 114 to either stamp, and/or pierce the hole 116 in the blank 102.

Subsequently, the hydroforming punch 114 is removed from the blank 102 after the stamping and/or piercing process during the hydroforming process performed by the system 100, as shown in FIG. 4. It will be appreciated by a person having ordinary skill in the art that FIGS. 1 to 4 are mere exemplary representations of the process of hydroforming, and are not to be considered as exact scaled representation of the same.

Figure 5:
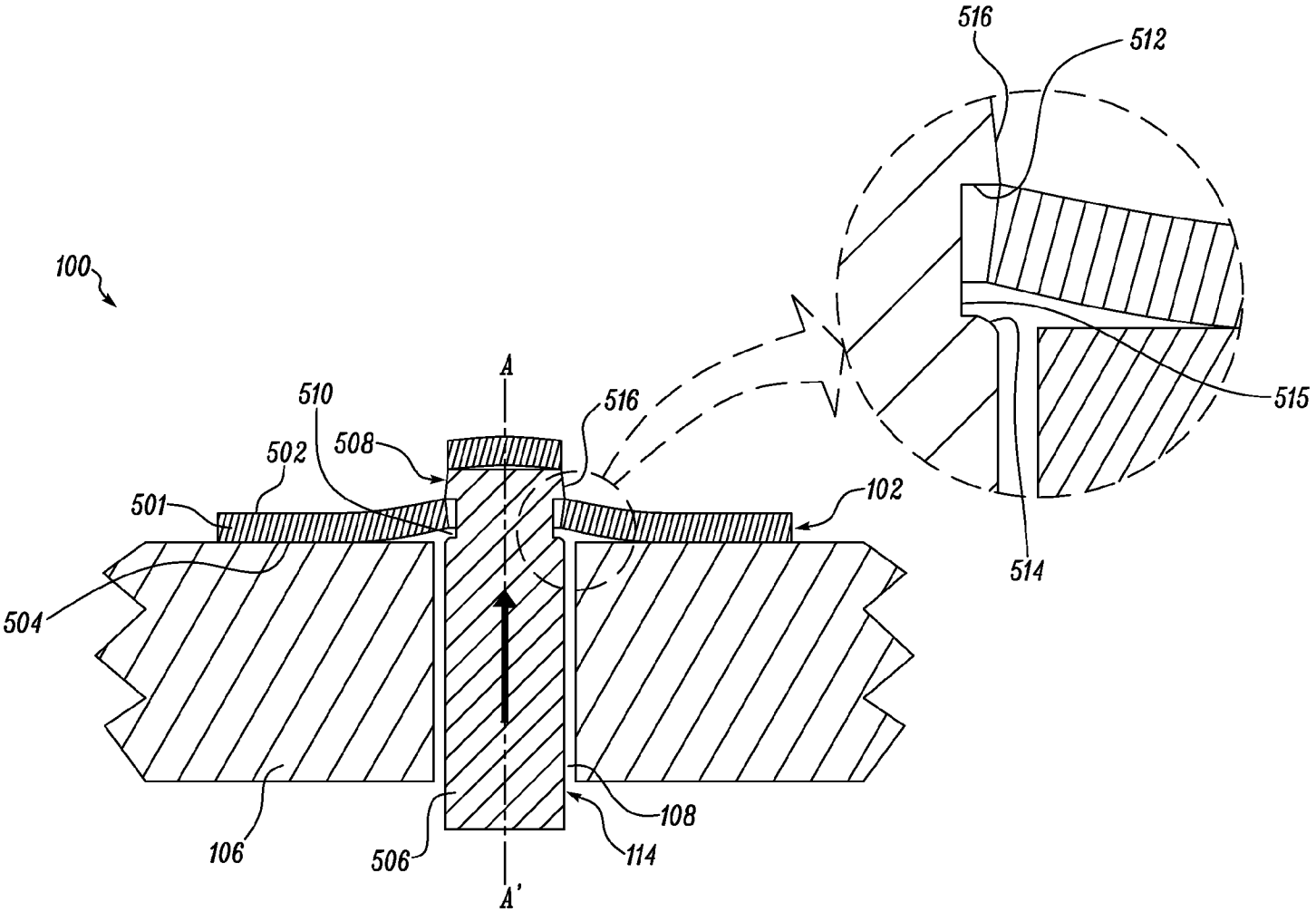
FIG. 5 illustrates a sectional view of the system with the hydroforming die element having the hydroforming punch, according to an aspect of the present disclosure.

FIG. 5 illustrates a cross sectional view of the system 100 with at least one of the die elements, such as, the lower hydroforming die element 104, having the hydroforming punch 114. For example, the lower hydroforming die element 104 may include the cavity 108 on which the blank 102 is placed. The blank 102 has a wall portion 501 having an inner surface 502 and an outer surface 504 placed on the hydroforming die element 104. The pressure of the fluid 112 filled within the blank 102 may be applied on the inner surface 502. Further, the hydroforming punch 114 may be configured to pierce the wall portion 501 of the blank 102 by contacting the outer surface 504 and passing through the wall portion 501 towards the inner surface 502, thereby forming the hole 116 in the blank 102. In an exemplary embodiment, a thickness of the wall portion 501 of the blank 102 is greater than or equal to 3 millimeter (mm).

In an aspect of the present disclosure, the punch 114, as illustrated in FIG. 5, includes a shank portion 506 and an engagement end, such as a cutting end 508 provided on the shank portion 506. The cutting end 508 of the punch 114 is configured to pass through the wall portion 501 of the blank 102 to form the hole 116 in the blank 102. The punch 114 is configured to travel in the direction of the cavity 108, as shown by arrow head, having the cutting end 508 travelling towards the blank 102. The cutting end 508 pierces the wall portion 501 of the blank 102 to form the hole 116.

In an exemplary aspect of the present disclosure, the cutting end 508 of the punch 114 may include a reduced cross-sectional portion 510. For example, the reduced cross sectional portion 510 may be formed by a groove, hereinafter referred to as the groove 510, circumferentially disposed about the cutting end 508 of the punch 114. The groove 510 may include at least one of a first surface 512 and a second surface 514, as shown in FIG. 5. In one example, the first surface 512 of the groove 510 may be substantially perpendicular to a longitudinal axis A-A' of the punch 114. Further, the second surface 514 of the groove 510 may be tapered along the longitudinal axis A-A' of the punch 114. The groove 510 may include a third surface 515 extending between the first surface 512 and the second surface 514 extending along the longitudinal axis A-A' of the punch 114. The third surface may be tapered or substantially parallel along the longitudinal axis A-A'. Furthermore, the cutting end 508 may have a cylindrical shape or a frusto-conical shape. For example, the cutting end 508 may include a tapered surface 516 extending from an axial end, i.e., the top of the punch 114 towards the cutting end 508. In one example, the cross-sectional area of the cutting end of the punch may increase from the initial engaging end of the cutting end 508 toward the reduced cross-sectional portion 510.

As the hole 116 is formed on the blank 102 by the hydroforming punch 114, material of the blank 102 surrounding the formed hole 116 tends to move in a first direction towards the inner surface 502 of the blank 102 and away from the cavity 108. As a result, the material of the blank 102 surrounding the formed hole 116 may move in the first direction to an initial displacement from an original position of a material of the blank 102. According to one aspect of the present disclosure, the groove 510 disposed on the cutting end 508 allows the material of the blank 102 surrounding the formed hole 116 to rest within the groove 510. For example, pressure of the fluid 112 filled within the blank 102 displaces the material of the blank 102 surrounding the formed hole 116 away from the initial displacement to an intermediate displacement into the reduced cross-sectional area 510 of the cutting end of the hydroforming punch 114. In an alternative embodiment, a spring back performance of the material of the blank 102 may cause the material of the blank 102 surrounding the formed hole 116 to spring back to the intermediate displacement into the reduced cross-sectional area 510. The intermediate displacement of the material of the blank 102 surrounding the formed hole 116 may be closer to the original position of the material of the blank 102 than the initial displacement. Further, the first surface 512 may face away from the inner surface 502 of the blank 102. Therefore, while removing the punch 114 from the blank cavity 108 in a withdrawal direction (opposite than the arrow shown in FIG. 5), the first surface 512 of the groove 510 may be configured to engage with the material of the blank 102 surrounding the formed hole 116. Such engagement from the first surface 512 may cause this surrounding material to be displaced away from the intermediate displacement in the withdrawal direction towards the cavity 108 to a final displacement. The final displacement of the material of the blank surrounding the formed hole 116 may be closer to the original position of the material of the blank 102, and desirably at the original position of the material of the blank 102, than the intermediate displacement.

Figure 6:
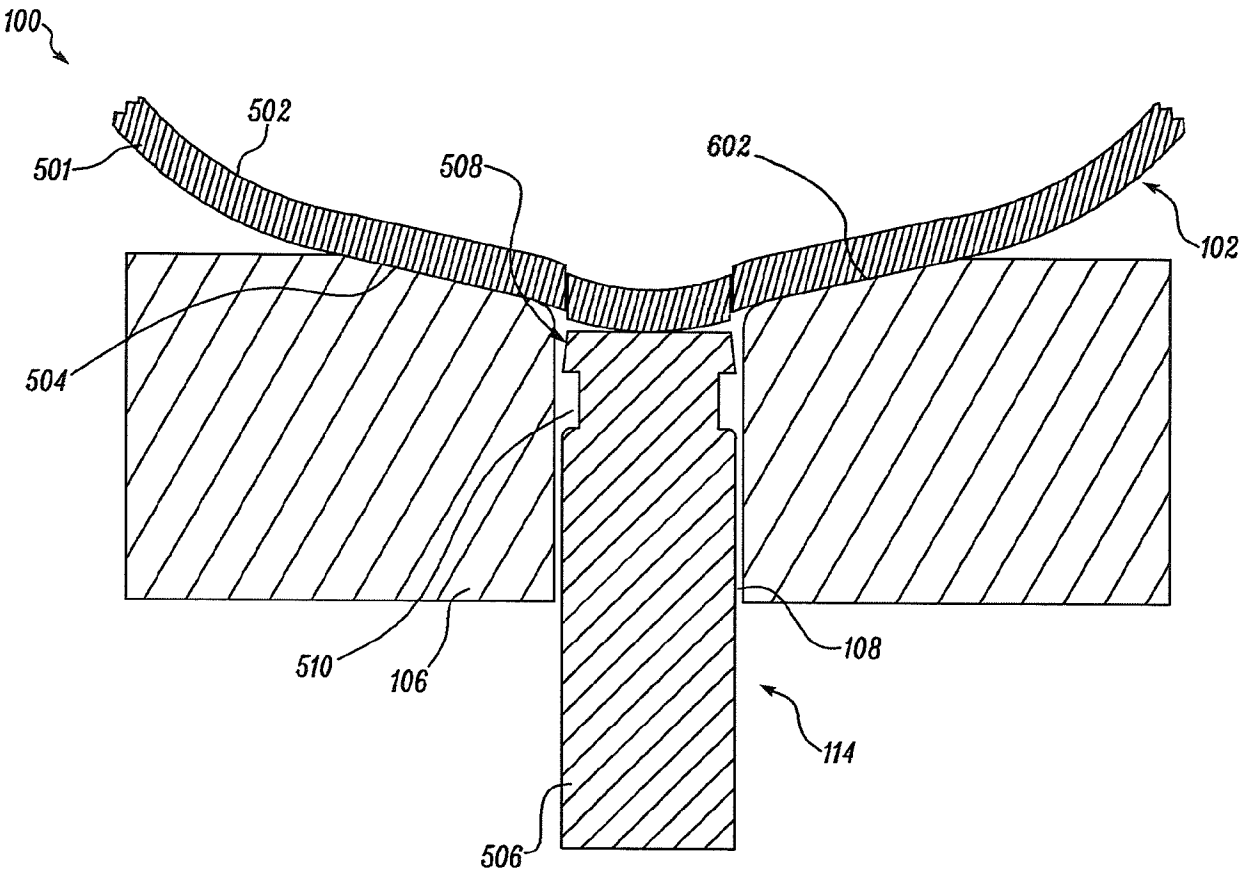
FIG. 6 illustrates the sectional view of the system with the hydroforming die element having the hydroforming punch, according to an alternate aspect of the present disclosure

Moreover, in an alternative aspect of the present disclosure, the groove 510 may cause the material of the blank 102 surrounding the hole 116 to be pulled back further from the final displacement and beyond the original position towards the cavity 108, as shown in FIG. 6. Therefore, the material surrounding the hole 116 may be closer to the original position such as continuous to the circular profile of the blank 102. Furthermore, the lower hydroforming die element 106 may alternatively include a recessed portion 602 positioned towards the cavity 108, and configured to facilitate the blank 102 to be placed properly on the cavity 108.

Figure 7:
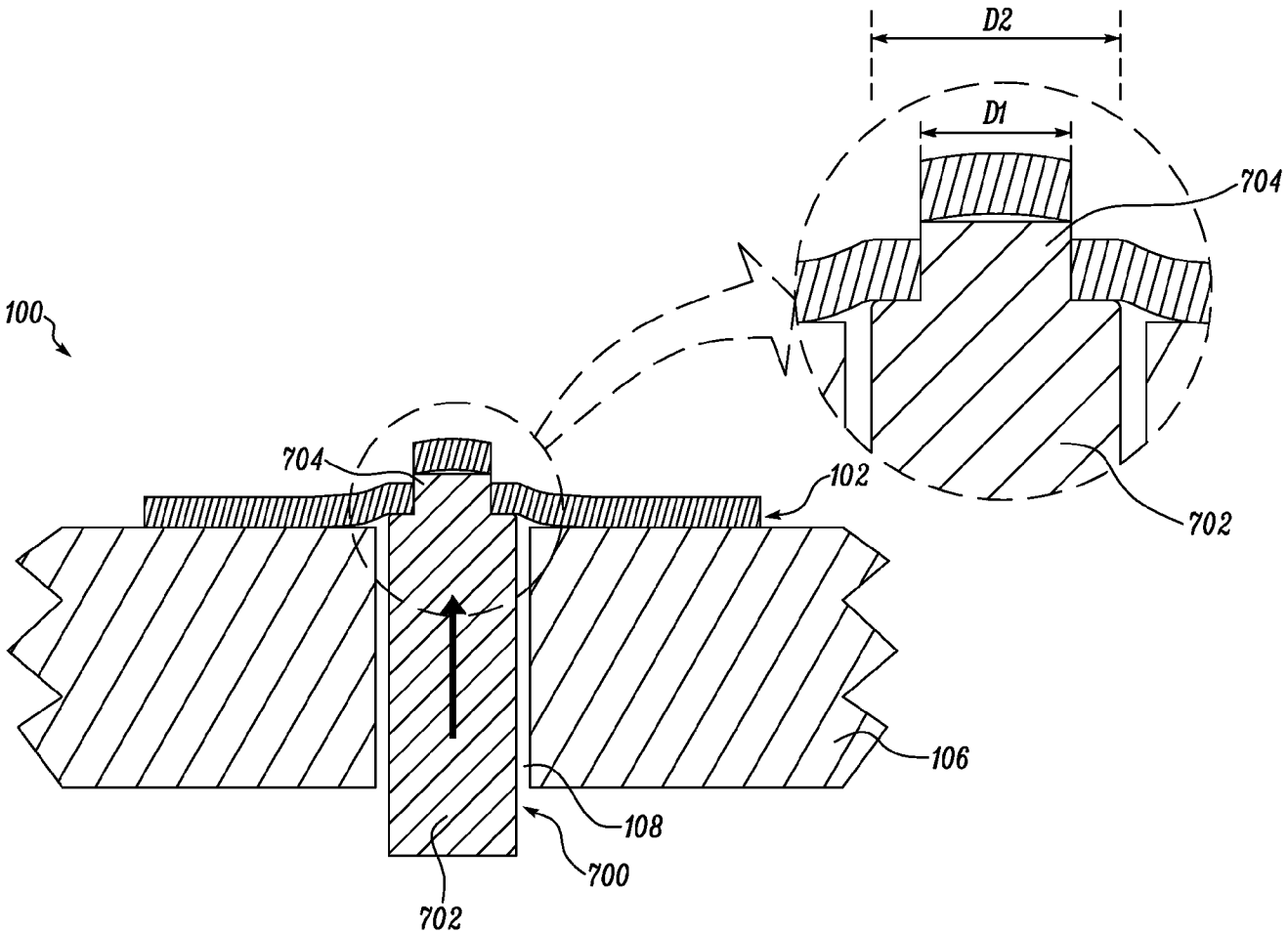
FIG. 7 illustrates a sectional view of the system with the hydroforming die element having a hydroforming punch, according to a third embodiment of the present disclosure.

FIG. 7 illustrates a sectional view of the system 100 with the lower hydroforming die element 106 having a hydroforming punch 700, according to a third embodiment of the present disclosure. As illustrated, the lower hydroforming die element 106 includes the cavity 108 on which the blank 102 is placed. In an aspect of the present disclosure, the punch 700 includes a shank portion 702 and an engagement end, such as a cutting end 704 provided on the shank portion 702. The cutting end 704 of the punch 700 is configured to pass through the blank 102 to form the hole 116 in the blank 102.

In an exemplary embodiment, the cutting end 704 of the punch 700 includes a stepped cross-sectional profile, such that a first diameter D1 of the cutting end 704 is less than a second diameter D2 of the shank portion 702. For example, the cutting end 704 is stepped to the larger diameter shank portion 702, as shown in FIG. 7.

Figure 8:
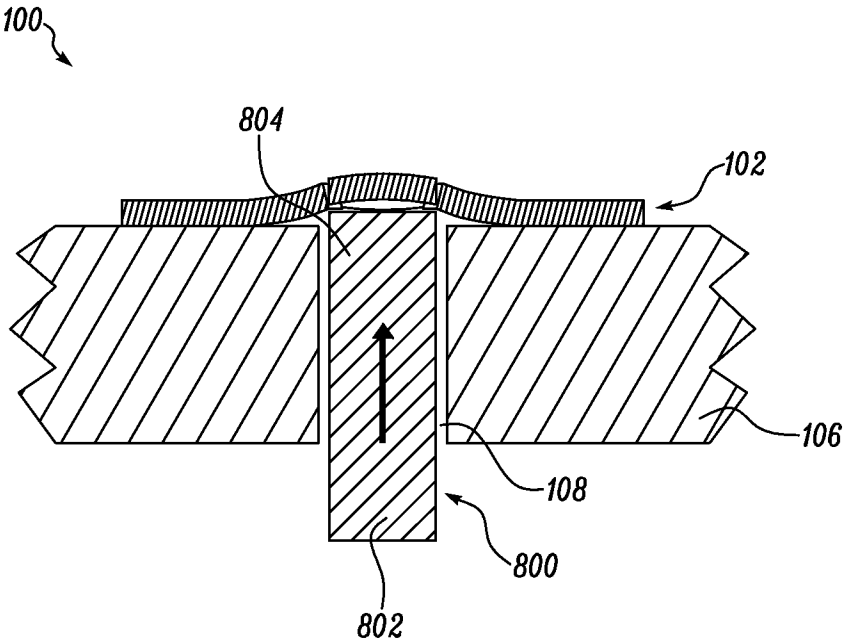
FIG. 8 illustrates a sectional view of the system with the hydroforming die element having a hydroforming punch, according to a fourth embodiment of the present disclosure.

FIG. 8 illustrates a sectional view of the system 100 with the lower hydroforming die element 106 having a hydroforming punch 800 according to a fourth embodiment of the present disclosure. As shown in the figure, the lower hydroforming die element 106 includes the cavity 108 on which the blank 102 is placed. In an aspect of the present disclosure, the punch 800 includes a shank portion 802 and an engagement end, such as a cutting end 804 provided on the shank portion 802. The cutting end 804 of the punch 800 is configured to pass through the blank 102 to form the hole 116 in the blank 102.

Figure 9:
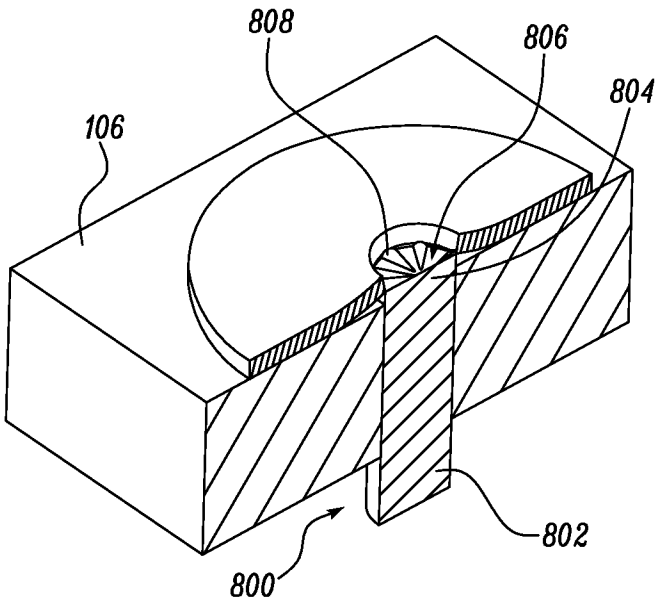
FIG. 9 illustrates a top view of the system with the hydroforming die element having the hydroforming punch, according to the fourth embodiment of the present disclosure.

In an aspect of the present disclosure, the cutting end 804 of the punch 800 includes a scalloped top 806, having a plurality of curved projections 808, as shown in FIG. 9. The scalloped top 806 of the punch 800 allows the cutting end 804 of the punch 800 to penetrate into the blank 102 by rotating and linear movement.

Figure 10:
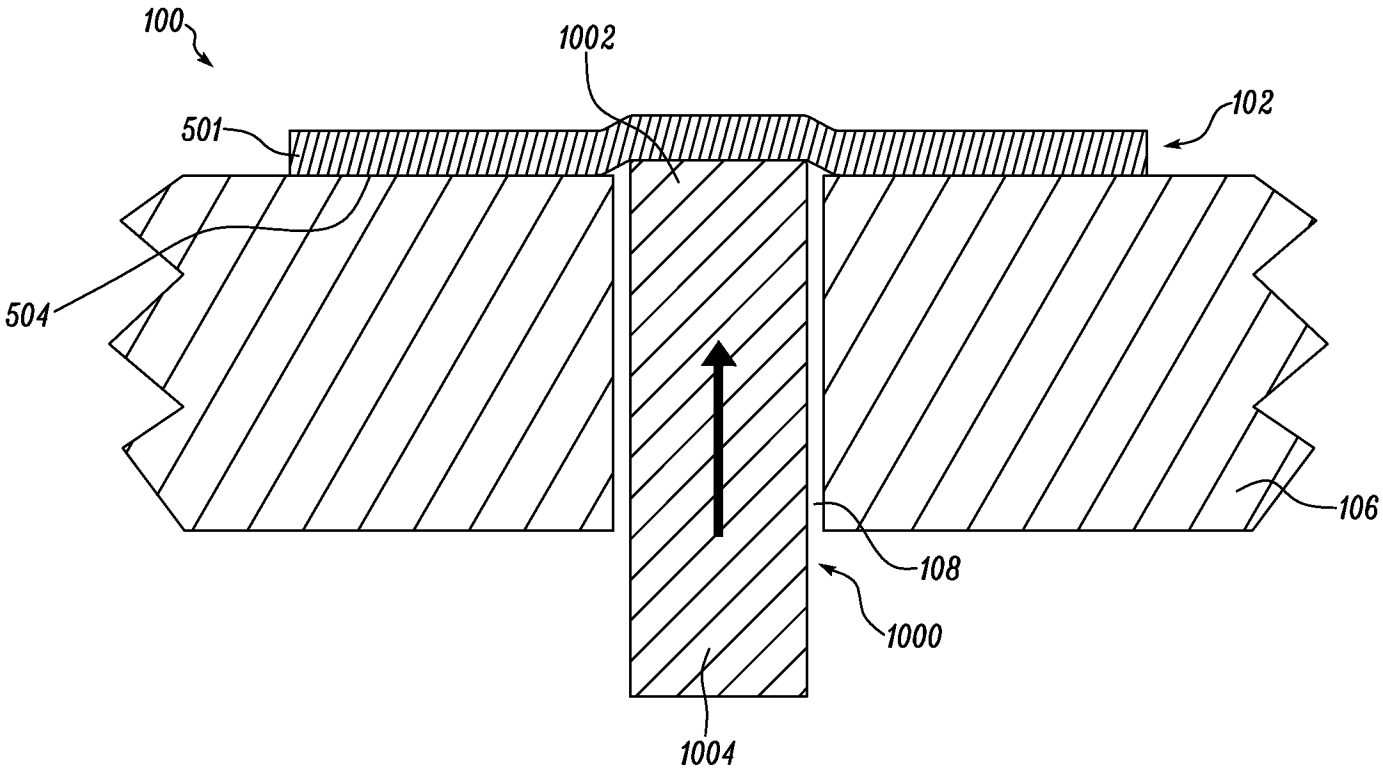
FIG. 10 illustrates a sectional view of the system with the hydroforming die element having a hydroforming punch, according to a fifth embodiment of the present disclosure.

FIG. 10 illustrates a sectional view of the system 100 with the lower hydroforming die element 106 having a hydroforming punch 1000 according to a fifth embodiment of the present disclosure. In an exemplary aspect, the punch 1000 may be configured to create a specific feature impression, such as coined impression on the hydro-formed blank 102.

In an aspect of the present disclosure, the punch 1000 includes an engagement end 1002 provided on a shank portion 1004, such that the engagement end 1002 engages with the outer surface 504 of the blank 102 while the blank 102 is under pressure during the hydroforming process. The punch 1000 then creates a coined impression on the wall portion 501 of the blank 102. In this case, the punch 1000 does not penetrate through the wall portion 501 of the blank 102 to form the hole 116, but it simply creates a coined impression on the blank 102. Subsequently, the punch 1000 is extracted out of the cavity 108.

Figure 11:
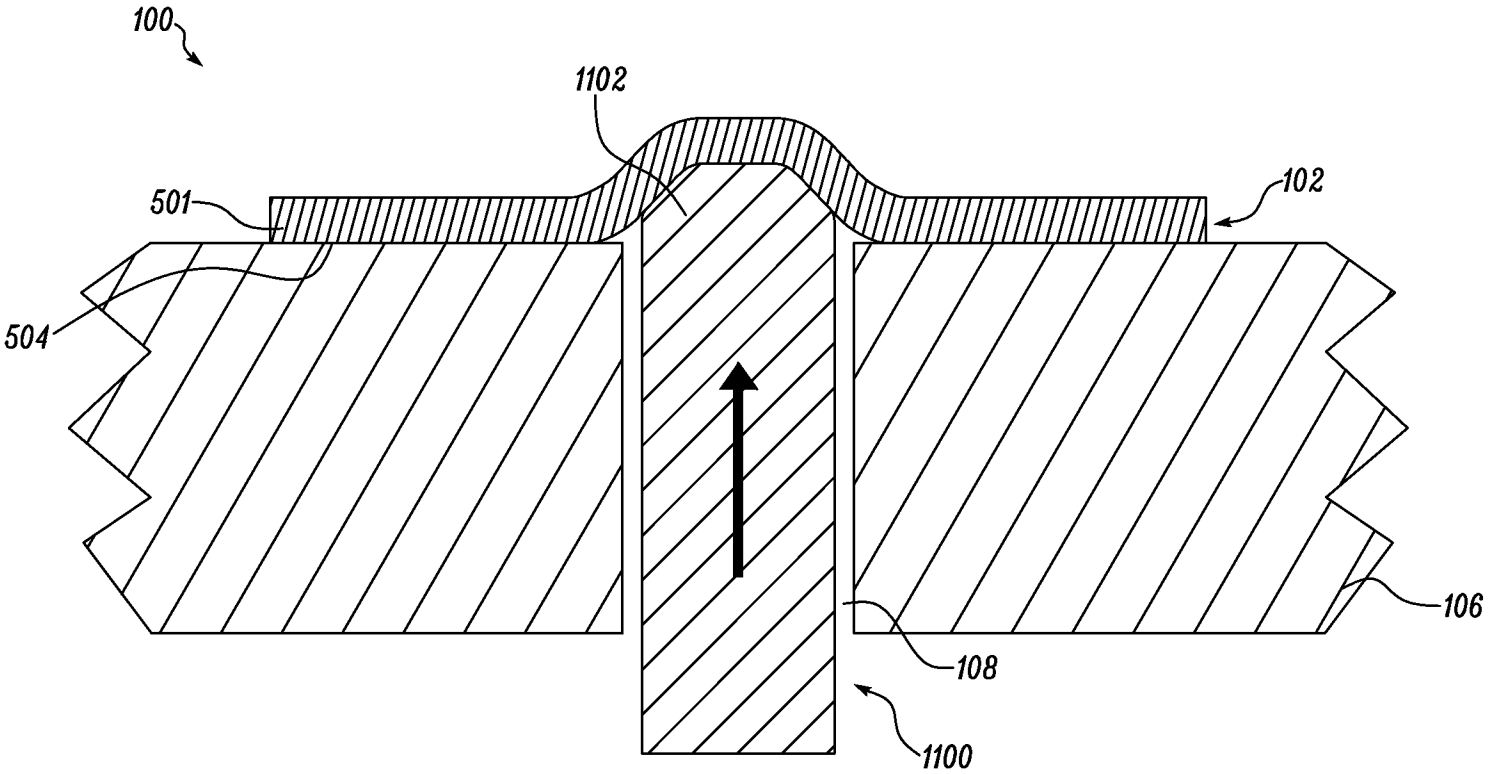
FIG. 11 illustrates a sectional view of the system with the hydroforming die element having a hydroforming punch, according to a sixth embodiment of the present disclosure.
Figure 12:
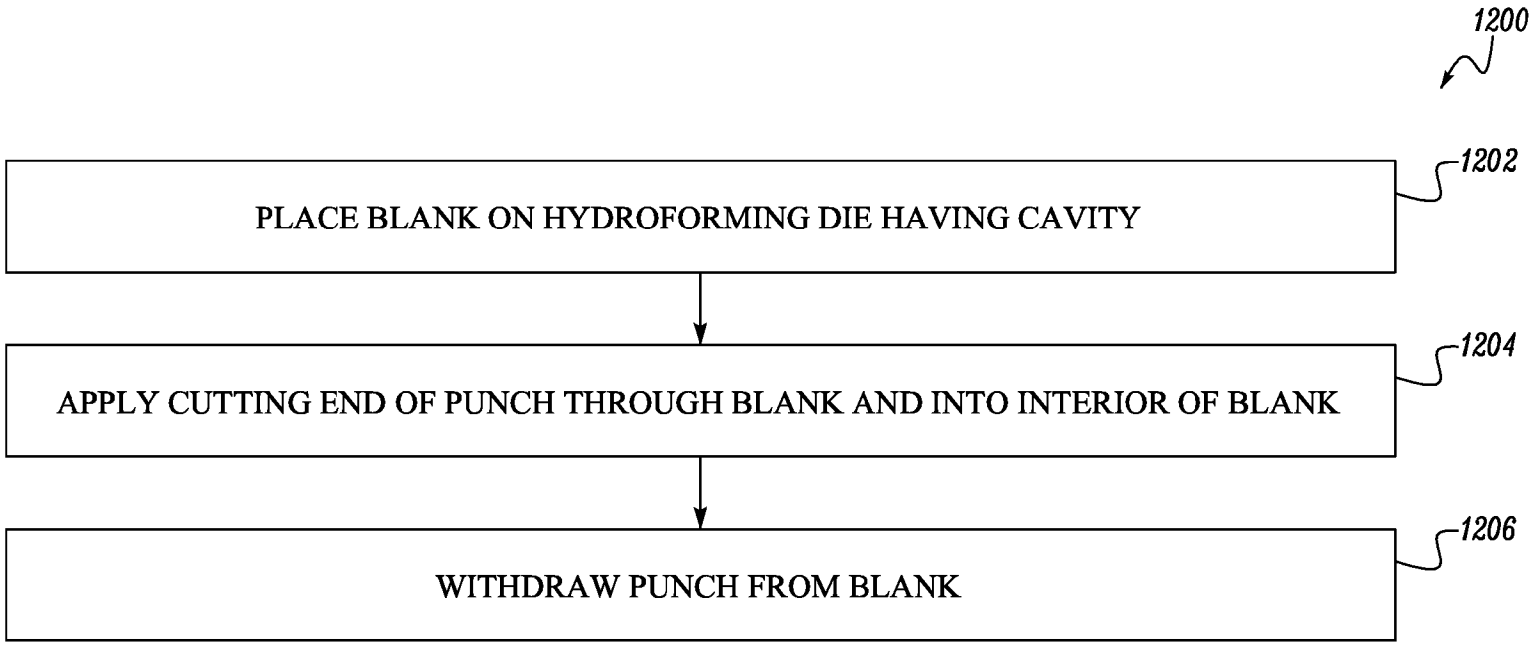
FIG. 12 illustrates a flowchart for a method of forming a hole in a hollow blank during a hydroforming process.

FIG. 11 illustrates a sectional view of the system 100 with the lower hydroforming die element 106 having a hydroforming punch 1100 according to a sixth embodiment of the present disclosure. The punch 1100 includes an engagement end 1102 having a conical profile. As explained in conjunction with FIG. 8, the engagement end 1102 of the punch 1100 engages with the outer surface 504 of the wall portion 501 of the blank 102, while the bank 102 is under pressure during the hydroforming process to form a conical protrusion and/or impression on the blank 102.

INDUSTRIAL APPLICABILITY

The industrial applicability of the system 100 having the punches 114, 500, 700, 800, 1000 and 1100, described herein will be readily appreciated from the foregoing discussion.

The present disclosure discloses a punch 114 which is used in forming a hole 116 in the hollow blank 102. The groove 510 disposed on the cutting end 508 of the punch 114 allows the material around the formed hole 116 to be pulled back to the original position. Additionally, maintaining the gap 113 between the lower hydroforming die element 106 and the blank 102 allows the material of the blank 102 to deform towards the cavity 108 prior to punch 114 engaging. As the punch 114 would deform the material of the blank 102 around the hole 116 towards the centre of the blank 102, the deformation of the material that was done prior to the punch 114 engagement may neutralize the deformation of the material around the hole 116 after the punch 114 engagement in an opposite direction. Therefore, there may be zero or minimum deformation of the material of the blank 102. Further, the punch 114 of the present disclosure prevents the permanent deformation of the material of the blank 102 surrounding the formed hole 116. The punch and method may be particularly useful for tubes having a thickness of greater than or equal to 3 mm. At such thicknesses, material may be difficult to punch and often results in permanent deformation of the material of the tube surrounding the formed hole. The punch and method may minimize the severity of the deformation surrounding the holes to make punching in heavy wall tubes possible with minimal permanent deformation. Such holes may be used to mount other components or parts to the tubes when employed as structural ROPS tubes or for fixturing the part for further assembly processing.

Further, the cutting end 704 of the punch 700 provides a controlled desired deformation, such as coining of the material of the blank 102 around the formed hole 116. Furthermore, the cutting end 804 of the punch 800 of the present disclosure provides a clean formation of the hole 116 and minimizes the permanent deformation of the material of the blank 102 around the formed hole 116.

In an aspect of the present disclosure, the punches 1000 and 1100 provide stamping of the blank 102. The engagement end 1002 of the punch 1000 creates the coined surface on the blank 102 which allows flush mounting of assembled components such as rivets, nut heads, hinge flanges etc. Further, the engagement end 1102 of the punch 1100 creates a conical protrusion on the inner surface 502 of the blank 102. This conical protrusion allows locating features near that area of the blank 102 or locating a part in a larger assembly to which the blank 102 is a part.

With additional reference to FIGS. 1-5, FIG. 12 illustrates a flowchart for a method 1200 of forming a hole 116 in a hollow blank 102 during a hydroforming process. Initially, at step 1202, the blank 102 may be placed on the hydroforming die element 104 having the cavity 108. The hydroforming die element 104 permits the punch 114 to engage with the blank 102. Further, a lower end of the cavity may be closed. In an exemplary embodiment of the present disclosure, the cutting end 508 of the punch 114 engages with the outer surface 504 of the wall portion 501 of the blank 102. Further, a fluid pressure is applied on the interior of the blank 102, as the blank 102 is filled with the fluid 112.

Further, at step 1204, the engagement end such as the cutting end 508 of the punch 114 may be applied through the wall portion 501 of the blank 102 and into the inner surface 502 of the blank 102. For example, the punch 114 may be moved at a sufficient force, speed, and distance to penetrate the wall portion of the tube, such as by a hydraulic press. The cutting end 508 of the punch 114 may pierce the wall portion 501 of the blank 102, such as shown in FIGS. 5-8. The punch 114 may be moved in at least one of a linear motion and a rotational motion. In an alternative embodiment, the engagement ends 1002 and 1102 of the punch 1000 and 1100 respectively may form a recess in the wall portion 501 of the blank 102, such as shown in FIGS. 10-11. In an aspect of the present disclosure, the cutting end 508 includes the groove 510 which allows the material around the formed hole 116 to relax in the groove 510.

Furthermore, at step 1206, the punch 114 may be withdrawn from the blank 102. In one example, the punch 114 may be withdrawn from the blank cavity 108, as shown in FIG. 4. In an aspect of the present disclosure, the groove 510 disposed on the cutting end 508 of the punch 114 pulls back the material of the blank 102 surrounding the formed hole 116, to the original position while the punch 114 is removed from the blank 102 after piercing the blank 102.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A method of forming holes in a hollow blank during a hydroforming process, the method comprising:

placing a blank in a cavity of a hydroforming die, the hydroforming die being configured to permit a punch to engage the blank;

maintaining a gap between the blank and a portion of the hydroforming die including the cavity;

pressurizing an interior of the blank with fluid;

deforming a portion of the blank into the gap and towards the cavity prior to an engagement of the punch with the blank, the portion of the blank corresponding to a path of the punch;

applying a cutting end of the punch through a wall portion of the blank and into the interior of the blank to form a hole; and removing the cutting end of the punch from the interior of the blank, wherein the cutting end of the punch is configured to allow material of the blank surrounding the hole to move away from the interior of the blank.

2. The method of claim 1, wherein during the applying step the material of the blank surrounding the hole moves away from the interior of the blank into a reduced cross-sectional portion of the cutting end, wherein the reduced cross-sectional portion forms a groove disposed circumferentially about the punch.

3. The method of claim 2, wherein a surface forming the groove is substantially perpendicular to a longitudinal axis of the punch.

4. The method of claim 2, wherein a surface forming the groove is tapered along a longitudinal axis of the punch.

5. The method of claim 1, wherein during the removing step the material of the blank surrounding the hole moves away from the interior of the blank by engagement with a surface of the cutting end facing away from the interior of the blank.

6. The method of claim 5, wherein the surface of the cutting end facing away from the interior of the blank is substantially perpendicular to a longitudinal axis of the punch.

7. The method of claim 5, wherein the surface of the cutting end facing away from the interior of the blank forms a circumferential groove.

8. The method of claim 1, wherein the cutting end of the punch includes a tapered surface extending from an axial end of the punch.

9. The method of claim 8, wherein the tapered surface is increasingly larger from the axial end of the punch.

10. The method of claim 1, wherein a thickness of the wall portion of the blank is about 3 millimeters or more.

11. A method of piercing holes in a wall of a tube during a hydroforming process, the method comprising:

placing a blank in a cavity of a hydroforming die, the hydroforming die being configured to permit a punch to engage the blank;

maintaining a gap between the blank and a portion of the hydroforming die including the cavity;

pressurizing an interior of the blank with fluid;

deforming a portion of the blank from an original position of a material of the blank into the gap and towards the cavity prior to an engagement of the punch with the blank, the portion of the blank corresponding to a path of the punch;

applying a cutting end of the punch through a wall portion of the blank and into the interior of the blank to form a hole, a portion of the cutting end of the punch having a groove circumferentially disposed about the punch, material surrounding the hole being displaced from the original position of the material of the blank by an initial displacement and then allowed to be displaced within the groove to an intermediate displacement closer to the original position of the material of the blank; and removing the cutting end of the punch from the interior of the blank, wherein a first surface forming the groove is capable of engaging the material surrounding the hole away from the intermediate displacement to a final displacement.

12. The method of claim 11, wherein during the removal of the cutting end, the material of the blank surrounding the hole is moved away from the interior of the blank by engagement with a first surface forming a portion of the groove, the first surface facing away from the interior of the blank.

13. The method of claim 11, wherein during the removal of the cutting end, the material of the blank surrounding the hole is moved away from the interior of the blank and beyond an original position of the blank.

14. The method of claim 11, wherein a thickness of the wall portion is greater than or equal to about 3 millimeters.

15. A punch for piercing a hole in a blank during a hydroforming process, the punch comprising:

a shank portion;

a cutting end provided on the shank portion and configured to form a hole in the blank; and a reduced cross-sectional area disposed about an outer surface of the punch and adjacent to the cutting end, the reduced cross-sectional area is configured to allow material of the blank surrounding the hole to move away from the interior of the blank, wherein a cross-sectional area of the cutting end increases about a longitudinal axis of the punch from an axial end of the shank to a first end of the reduced cross-sectional area that is adjacent to the cutting end, wherein a cross-sectional area of a second end of the reduced cross-sectional area increases about the longitudinal axis of the punch from an end of a portion of the reduced cross-section area that is positioned between the first end and the second end and has a cross-sectional area less than the cross-sectional area of the cutting end.

16. The punch of claim 15, wherein the reduced cross-sectional area is shaped as a continuous groove.

17. The punch of claim 15, wherein the cutting end includes a tapered surface.

18. The punch of claim 16, wherein the continuous groove is defined by a first surface at the first end that is substantially perpendicular to the longitudinal axis of the punch.

19. The punch of claim 17, wherein the continuous groove is defined by a second surface at the second end that is tapered along the longitudinal axis of the punch.

* * * * *